US011375818B1

(12) United States Patent
Hu

(10) Patent No.: US 11,375,818 B1
(45) Date of Patent: Jul. 5, 2022

(54) GARDEN CHAIR

(71) Applicant: Baoguang Hu, Shenzhen (CN)

(72) Inventor: Baoguang Hu, Shenzhen (CN)

( * ) Notice: Subject to any disclaimer, the term of this patent is extended or adjusted under 35 U.S.C. 154(b) by 0 days.

(21) Appl. No.: 17/504,480

(22) Filed: Oct. 18, 2021

(30) Foreign Application Priority Data

Sep. 26, 2021 (CN) ..... 2021223442204

(51) Int. Cl.
*A47C 7/02* (2006.01)
*A47C 7/00* (2006.01)

(52) U.S. Cl.
CPC ..... *A47C 7/0213* (2018.08); *A47C 7/002* (2013.01)

(58) Field of Classification Search
None
See application file for complete search history.

(56) References Cited

U.S. PATENT DOCUMENTS 2,247,667 A * 7/1941 Rosberger ..... A47C 27/001 5/723
3,276,817 A * 10/1966 Marple ..... A47C 1/026 297/377
3,656,809 A * 4/1972 Ronning ..... A47C 16/02 297/461
3,856,345 A * 12/1974 Beckley ..... A47C 4/30 297/16.1
4,311,337 A * 1/1982 Brunn ..... A47B 83/02 297/342
4,435,014 A * 3/1984 Gilardi ..... A47C 7/22 5/186.1
4,462,636 A * 7/1984 Markson ..... A47C 16/02 108/131
4,630,863 A * 12/1986 Roberts ..... A47C 27/001 297/219.1
4,835,029 A * 5/1989 Thebaud ..... A47C 31/10 297/452.1
4,889,383 A * 12/1989 Jones ..... A47C 4/02 297/16.1
5,069,503 A * 12/1991 Martinez ..... A47C 1/16 297/54
5,954,391 A * 9/1999 Gray ..... A47C 4/18 297/58
7,654,617 B2 * 2/2010 Farnsworth ..... A47C 7/024 297/452.56
8,833,518 B2 * 9/2014 Holcombe ..... A01M 31/02 182/33

(Continued)

FOREIGN PATENT DOCUMENTS

WO WO-2015157342 A1 * 10/2015 ..... A47C 27/00

*Primary Examiner* — David E Allred

(57) ABSTRACT

The present disclosure provides a garden chair including: a garden chair body, including a first chair leg, a second chair leg, and a carrying frame; wherein the first chair leg is spaced apart relative to the second chair leg; an end of the carrying frame is arranged on the first chair leg, and the other end of the carrying frame is arranged on the second chair leg; and a cushion, removably arranged on the carrying frame. In the garden chair provided by the present disclosure, the cushion is removably arranged in the carrying frame, such that the cushion is easy to clean and replace, and the disassembled cushion can be applied to a variety of functional kneeling cushion and seat upholstery mobile cushion.

10 Claims, 3 Drawing Sheets

(56) References Cited

U.S. PATENT DOCUMENTS

| | | | | |
|---|---|---|---|---|
| 2002/0025221 | A1* | 2/2002 | Johnson | E01F 15/086 404/6 |
| 2003/0070702 | A1* | 4/2003 | Ownes | A61H 3/00 135/74 |
| 2004/0231918 | A1* | 11/2004 | Meeker | A47C 12/02 182/33 |
| 2011/0073723 | A1* | 3/2011 | Ashpole | A47C 4/20 248/176.2 |
| 2011/0181091 | A1* | 7/2011 | Kim | A47C 16/025 297/423.41 |
| 2013/0187429 | A1* | 7/2013 | Guerrero | A47C 5/005 297/452.18 |
| 2014/0276306 | A1* | 9/2014 | Dreske | A61H 3/04 602/19 |
| 2014/0346817 | A1* | 11/2014 | Tseng | A47C 4/44 297/16.1 |
| 2015/0001899 | A1* | 1/2015 | Line | B60N 2/809 297/396 |
| 2015/0083522 | A1* | 3/2015 | Chancier | A47C 12/00 182/152 |
| 2015/0322717 | A1* | 11/2015 | Gibson | A47C 12/00 182/210 |
| 2017/0334059 | A1* | 11/2017 | Moffat | B25H 1/04 |
| 2018/0235374 | A1* | 8/2018 | Kroll | A47C 27/146 |
| 2021/0339786 | A1* | 11/2021 | Williams | B62B 7/004 |
| 2021/0378405 | A1* | 12/2021 | Boyer | A47C 12/00 |
| 2021/0393035 | A1* | 12/2021 | Arnold | F16B 1/00 |
| 2022/0104605 | A1* | 4/2022 | Lacehapelle | A45F 4/02 |

* cited by examiner

GARDEN CHAIR

TECHNICAL FIELD

The present disclosure relates to the field of seating technologies, and in particular to a garden chair.

BACKGROUND

The cushion of the existing garden chair is easy to dirty but not easy to clean. When the cushion of the garden chair is damaged, it is not easy to replace a new cushion. Therefore, consumers can only buy a new garden chair, increasing the cost of living of the consumers.

Therefore, there is a need to provide a new garden chair to solve the above problems.

SUMMARY OF THE DISCLOSURE

The purpose of the present disclosure is to provide a garden chair that is easy to clean the cushion and easy to replace the cushion.

The present disclosure provides a garden chair, comprising: a garden chair body, comprising a first chair leg, a second chair leg, and a carrying frame; wherein the first chair leg is spaced apart relative to the second chair leg; an end of the carrying frame is arranged on the first chair leg, and the other end of the carrying frame is arranged on the second chair leg; and a cushion, removably arranged on the carrying frame.

In some embodiments, the cushion comprises a first soft cushion, a second soft cushion, and connection members; the first soft cushion and the second soft cushion are arranged on opposite sides of the carrying frame, respectively; two of the connection members are arranged on two ends of the first soft cushion, respectively; another two of the connection members are arranged on two ends of the second soft cushion, respectively; each of the two ends of the first soft cushion is detachably connected to a corresponding end of the two ends of the second soft cushion via corresponding connection members.

In some embodiments, the cushion comprises a first soft cushion, a second soft cushion, and connection members; the first soft cushion and the second soft cushion are arranged on opposite sides of the carrying frame, respectively; an end of the first soft cushion is reversibly connected to an end of the second soft cushion; another end of the first soft cushion is detachably connected to another end of the second soft cushion via the connection members.

In some embodiments, each connection member is at least one of hook and loop, concealed buckle, button, zipper, snap, and strap.

In some embodiments, the first soft cushion comprises a first cushion body and a first connection body extending from the first cushion body; the connection members are arranged connecting the first cushion body and the second soft cushion such that the first soft cushion and the second soft cushion are detachably connected.

In some embodiments, the carrying frame comprises a first connection rod and a second connection rod; the first connection rod and the second connection rod are relatively spaced apart; an end of the first connection rod and an end of the second connection rod are respectively rotatably arranged on the first chair leg; the other end of the first connection rod and the other end of the second connection rod are respectively rotatably arranged on the second chair leg.

In some embodiments, the garden chair further comprises a support member arranged between the first connection rod and the second connection rod; or, the support member is arranged on a side of the first soft cushion near the first connection rod and the second connection rod and on a side of the second soft cushion near the first connection rod and the second connection rod.

In some embodiments, in condition of the support member being arranged between the first connection rod and the second connection rod, the support member is removably arranged between the first connection rod and the second connection rod by a screw.

In some embodiments, the support member comprises a reinforcing frame and a reinforcing skeleton; the reinforcing skeleton is arranged in and connected to the reinforcing frame.

In some embodiments, the reinforcing skeleton is formed by a plurality of reinforcing bars intersecting each other, and a plurality of through holes are defined between the plurality of reinforcing bars and between the plurality of reinforcing bars and the reinforcing frame.

In the garden chair provided by the present disclosure, the cushion is removably arranged in the carrying frame, such that the cushion is easy to clean and replace, and the disassembled cushion can be applied to a variety of functional kneeling cushion and seat upholstery mobile cushion.

BRIEF DESCRIPTION OF THE DRAWINGS

In order to more clearly describe the technical solutions in the embodiments of the present disclosure, the following will briefly introduce the drawings required in the description of the embodiments. Obviously, the drawings in the following description are only some embodiments of the present disclosure. For those skilled in the art, other drawings can be obtained based on these drawings without creative work.

For a more complete understanding of the present disclosure and its beneficial effects, the following will be described in connection with the accompanying drawings. Therein, same accompanying symbols in the following description indicate a same part.

DETAILED DESCRIPTION

The following will be a clear and complete description of the technical solutions in the embodiments of the present disclosure in conjunction with the accompanying drawings in the embodiments of the present disclosure. Obviously, the described embodiments are only a part of the embodiments of the present disclosure, and not all of them. Based on the embodiments in the present disclosure, all other embodiments obtained by those skilled in the art without making creative labor fall within the scope of the present disclosure.

Figure 1:
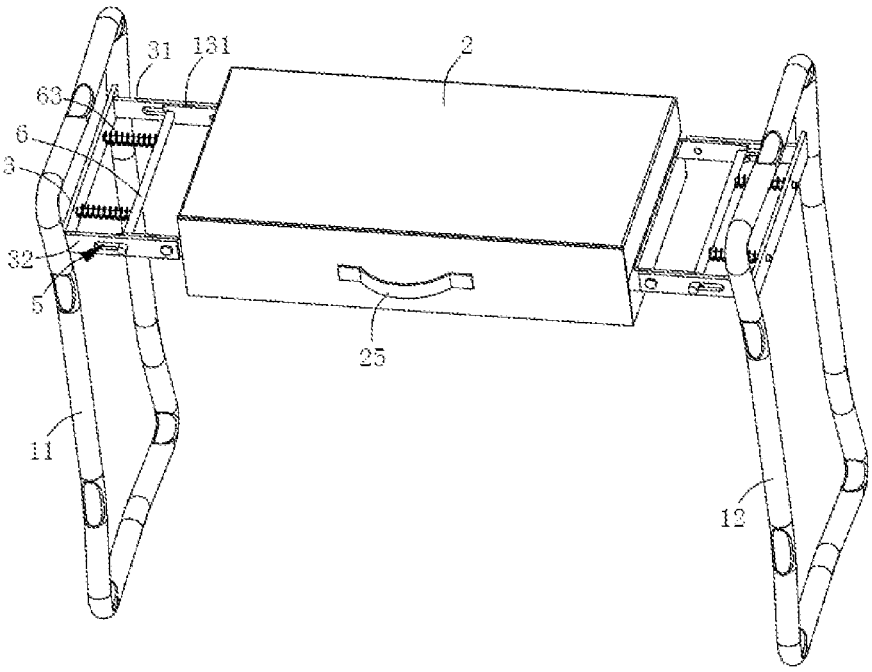
FIG. 1 is a structural schematic view of a garden chair according to an embodiment of the present disclosure.
Figure 2:
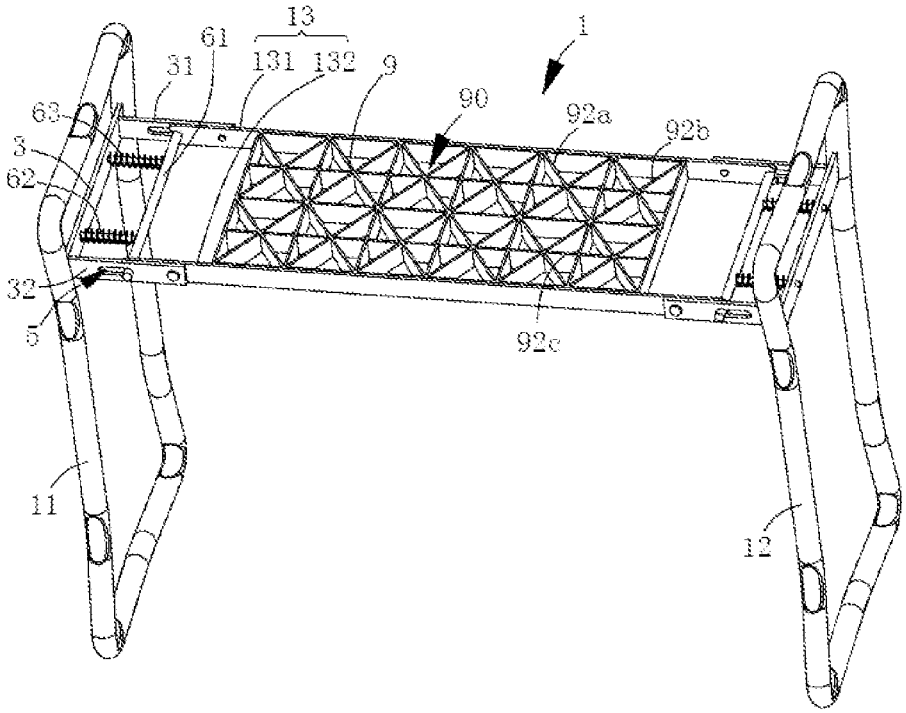
FIG. 2 is a structural schematic view of a body of a garden chair according to an embodiment of the present disclosure.
Figure 3:
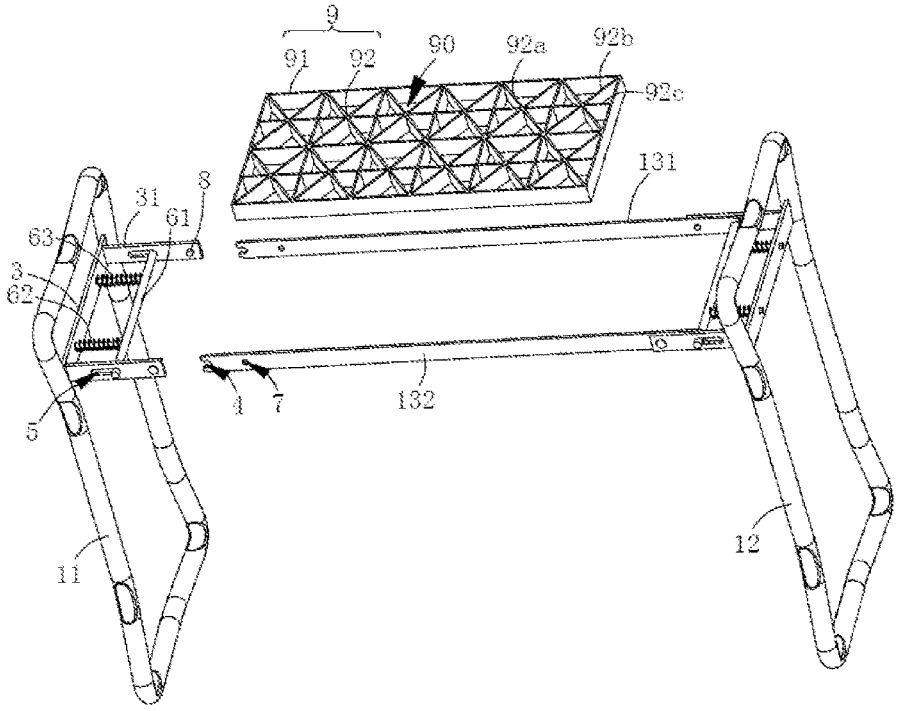
FIG. 3 is a partially-exploded structural schematic view of a body of a garden chair according to an embodiment of the present disclosure.
Figure 4:
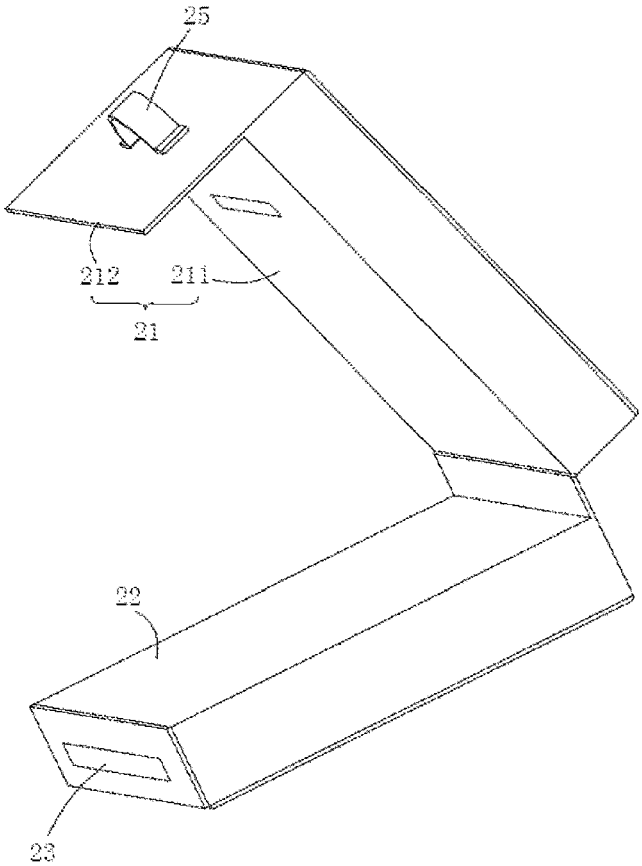
FIG. 4 is a structural schematic view of a cushion according to an embodiment of the present disclosure.
Figure 5:
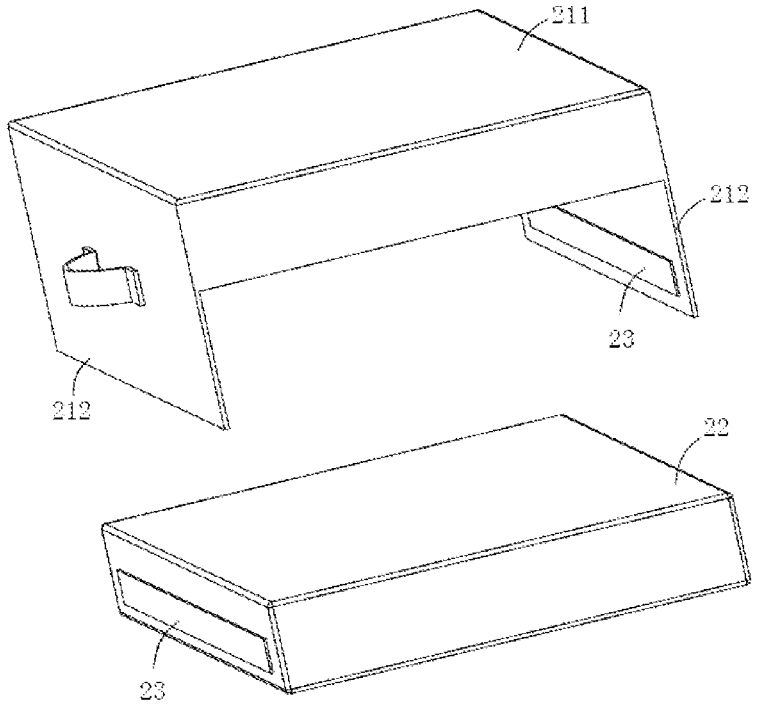
FIG. 5 is a structural schematic view of a cushion according to another embodiment of the present disclosure.
Figure 6:
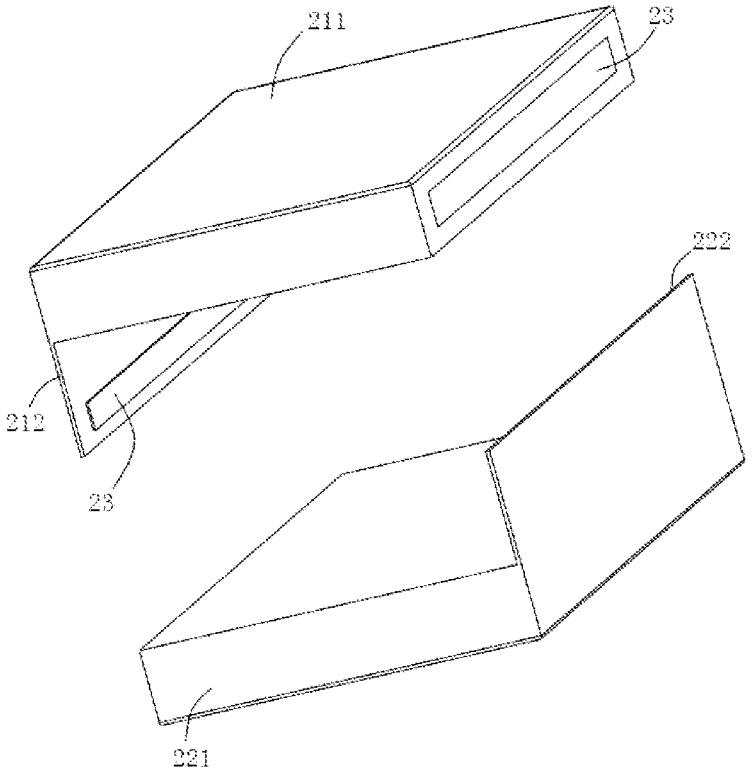
FIG. 6 is a structural schematic view of a cushion according to further another embodiment of the present disclosure.

Referring to FIGS. 1-6, FIG. 1 is a structural schematic view of a garden chair according to an embodiment of the present disclosure. FIG. 2 is a structural schematic view of a main body of a garden chair according to an embodiment of the present disclosure. FIG. 3 is a partially-exploded structural schematic view of a main body of a garden chair according to an embodiment of the present disclosure. FIG. 4 is a structural schematic view of a cushion according to an embodiment of the present disclosure. FIG. 5 is a structural schematic view of a cushion according to another embodiment of the present disclosure. FIG. 6 is a structural schematic view of a cushion according to further another embodiment of the present disclosure.

The garden chair 100 may be configured as a seat or a kneeling stool, including a garden chair body 1 and a cushion 2. The garden chair body 1 includes a first chair leg 11, a second chair leg 12 and a carrying frame 13. The first chair leg 11 and the second chair leg 12 are relatively spaced apart. An end of the carrying frame 13 is arranged on the first chair leg 11 and the other end is arranged on the second chair leg 12. The cushion 2 is removably arranged on the carrying frame 13. By virtue of the cushion 2 removable arranged on the carrying frame 13 of the garden chair 100, the cushion 2 of the garden chair 100 is easy to clean and replace, and the cushion 2, when removed, may be applied to a variety of functional kneeling cushion and seat upholstery mobile cushion.

The cushion 2 includes a first soft cushion 21, a second soft cushion 22 and a connection member 23. The first soft cushion 21 and the second soft cushion 22 are arranged on opposite sides of the carrying frame 13, respectively. The first soft cushion 21 is removably arranged on the second soft cushion 22 by the connection member 23. Exemplarily, as shown in FIG. 4, the number of the connection member 23 is one. An end of the first soft cushion 21 is detachably connected to the second soft cushion 22 by the connection member 23, and the other end of the first soft cushion 21 is reversibly attached to the second soft cushion 22. It should be noted that in other embodiments, as shown in FIG. 5 or FIG. 6, the number of the connection members 23 may be two. Opposite ends of the first soft cushion 21 are each detachably connected to the second soft cushion 22 by the connection member 23. Such design is more convenient for a user to remove the cushion 2 from the carrying frame 13, thus improving the user experience.

The connection member 23 may be at least one of: hook and loop, concealed buckle, button, zipper, snap fastener and strap. Exemplarily, as shown in FIG. 4, the first soft cushion 21 includes a first cushion body 211 and a first connection body 212 extending from the first cushion body 211. The connection member 23 connects the first connection body 212 and the second soft cushion 22 to make the first soft cushion 21 and the second soft cushion 22 detachably connected. The connection member 23 is hook and loop, i.e., the connection member 23 includes a male side and a female side. The male side is arranged on the first connection body 212 and the female side is arranged on the second soft cushion 22 at a position corresponding to the first connection body 212. The male side and the female side may be matched and connected, such that the first soft cushion 21 and the second soft cushion 22 are removable. It should be noted that a side of the first cushion body 211 near the second soft cushion 22 is also arranged with a female side, such that when the first soft cushion 21 and the second soft cushion 22 are disassembled, the first connection body 212 is bonded to the first cushion body 211 through a cooperation of the male side and the female side, thus improving the aesthetics of the cushion 2 after disassembly.

When two connection members 23 are arranged, as shown in FIG. 5, two first connection bodies 212 are arranged. The first connection bodies 212 are arranged on opposite sides of the first cushion body 211 respectively, and the first connection bodies 212 are each detachably connected to the second soft cushion 22 via a corresponding connection member 23. It is noted that in other embodiments, as shown in FIG. 6, one first connection body 212 is arranged, and the second soft cushion 22 includes a second cushion body 221 and a second connection body 222 extending from an end of the second cushion body 221 away from the first connection body 212. The first connection body 212 is detachably connected to the second soft cushion 22 via a corresponding connection member 23. The second connection body 222 is detachably connected to the first soft cushion 21 via another corresponding connection member 23.

It should be noted that in other embodiments, the connection member 23 may be at least one of a concealed buckle, button, snap, zipper or strap. The design of the concealed buckle, button, snap, zipper or strap can make the first soft cushion 21 and the second soft cushion 22 more stable and longer life.

It can be understood that the first soft cushion 21 and the second soft cushion 22 near the side of the carrying frame 13 may be arranged with convex particles for increasing the friction between the first soft cushion 21 and the second soft cushion 22 and the carrying frame. This design can prevent the cushion 2 from sliding when the garden chair 100 is in use.

The cushion 2 may also include a carrying part 25 arranged on the first connection body 212 or the second connection body 222. Exemplarily, the carrying part 25 is arranged on the first connection body 212. The carrying part 25 is convenient for the user to carry the garden chair 100 or convenient for the user to remove the cushion 2, thus improving the user experience.

In some embodiments, the carrying frame 13 includes a first connection rod 131 and a second connection rod 132. The first connection rod 131 and the second connection rod 132 are relatively spaced apart. An end of the first connection rod 131 and an end of the second connection rod 132 are respectively rotatably arranged on the first chair leg 11. The other end of the first connection rod 131 and the other end of the second connection rod 132 are respectively rotatably arranged on the second chair leg 12. In this way, the first chair leg 11 and the second chair leg 12 can be rotated relative to the carrying frame 13, that is, the first chair leg 11 and the second chair leg 12 of the garden chair 100 can be folded. When the user is not using the garden chair 100, the first chair leg 11 and the second chair leg 12 can be folded closer to the carrier 13, thus making it easier for the user to carry.

In some embodiments, the first chair leg 11 and the second chair leg 12 are each formed by a metal tube bent and welded, and the first chair leg 11 and the second chair leg 12 are each arranged with a fixing rod 3 at a position corresponding to the carrying frame 13. An end of the fixing rod 3 includes a third connection rod 31 extending close to the first connection rod 131, and the other end of the fixing rod 3 includes a fourth connection rod 32 extending close to the second connection rod 132. The third connection rod 31 is rotatably arranged on the first connection rod 131 at an end far from the fixed rod 3, and the fourth connection rod 32 is rotatably arranged on the second connection rod 132 at an end far from the fixed rod 3. The first connection rod 131 and the second connection rod 132 each defines a first locking slot 4 at both ends, and the third connection rod 31 and the fourth connection rod 32 each defines a second locking slot 5 at positions corresponding to the first locking slots 4.

The garden chair 100 may further includes a locking rod 6, which is slidably arranged in the first locking slots 4 and the second locking slots 5. Exemplarily, the locking rod 6 includes a cross rod 61 and a guide rod 62. The cross rod 61 is slidingly arranged in the first locking slots 4 and the second locking slots 5. When the cross rod 61 is arranged in both the first locking slots 4 and the second locking slots 5, an end of the cross rod 61 can fix the first connection rod 131 and the third connection rod 31, and the other end can fix the second connection rod 132 and the fourth connection rod 32. An end of the guide rod 62 is inserted on the fixing rod 3, and the other end is arranged on the cross rod 61. The guide rod 62 is arranged with a spring 63. When the first chair leg 11 and the second chair leg 12 are not folded, the guide rod 62 and the spring 63 are configured to confine the cross rod 61 to the first locking slots 4. When the first chair leg 11 and the second chair leg 12 are required to be folded, the user may simply press the cross rod 61, which in turn compresses the spring 63, causing the cross rod 61 to slide away from the first locking slot 4*s*. After the cross rod 61 slides out of the first locking slots 4, the first chair leg 11 and the second chair leg 12 are then folded closer to the carrying frame 13. It can be understood that the number of the guide rods 62 may be plural, and the plurality of guide rods 62 are evenly arranged between the fixed rod 3 and the cross rod 61, such that when the cross rod 61 is pressed, the cross rod 61 is evenly stressed, thus preventing left and right ends from being out of sync during the sliding of the cross rod 61.

The first connection rod 131 and the second connection rod 132 each define an axle hole 7, which is closer to the carrying frame 13 than a corresponding first locking slot 4. The third connection rod 31 and the fourth connection rod 32 are each arranged with a pivot 8 at a position corresponding to a corresponding axle hole 7. The pivot 8 is arranged in the axle hole 7 such that the first chair leg 11 and the second chair leg 12 are respectively connected to the carrying frame 13 by rotation.

The garden chair 100 may further include a locking-rod support member 9 configured to support the cushion 2. The support member 9 is arranged between the first connection rod 131 and the second connection rod 132, or the support member 9 is arranged on a side of the first soft cushion 21 and on a side of the second soft cushion 22 near the first connection rod 131 and the second connection rod 132, respectively. Exemplarily, as shown in FIG. 3, the support member 9 is removably arranged between the first connection rod 131 and the second connection rod 132 by a screw. The support member 9 is made of hard plastic and includes a reinforcing frame 91 and a reinforcing skeleton 92. The reinforcing skeleton 92 is arranged in the reinforcing frame 91 and connected to the reinforcing frame 91. The configuration of the support member 9 can reduce the weight of the garden chair 100 while also reducing the production cost of the garden chair 100. Moreover, when the support member 9 is damaged, the damaged support member 9 can be disassembled and replaced with a new support member 9. It should be noted that in other embodiments, the support member 9 may also be arranged on a side of the first soft cushion 21 and on a side of the second soft cushion 22 near the first connection rod 131 and the second connection rod 132, respectively.

The reinforcing skeleton 92 is formed by a plurality of reinforcing bars arranged crosswise with each other, and a plurality of through-holes 90 are defined between the plurality of reinforcing bars and between the plurality of reinforcing bars and the reinforcing frame. The plurality of through-holes 90 may prevent the cushion 2 from sliding, that is, when the user sits on the cushion 2, the force on the cushion 2 makes part of the cushion 2 fall into the through-holes 90, so as to play a role in preventing the cushion 2 from sliding. It should be noted that the reinforcement skeleton 92 may also be formed by a plurality of reinforcement bars arranged parallel to each other.

The reinforcing skeleton 92 and the reinforcing frame 91 are connected to form a plurality of identical cells, the cells are square in shape, and the reinforcing bars divide the cells into a plurality of identical triangles. In the embodiment, the reinforcing bars include a plurality of first reinforcing bars 92*a* that are parallel to each other and spaced apart, a plurality of second reinforcing bars 92*b* that are parallel to each other and spaced apart, and a plurality of third reinforcing bars 92*c* that are parallel to a long side of the reinforcing frame 91 and spaced apart. The first reinforcing bars 92*a*, the second reinforcing bars 92*b* and the third reinforcing bars 92*c* are intersected to separate the area enclosed by the reinforcing frame 91 into the plurality of square cells, each square cell including six triangular through-holes 90.

The first soft cushion 21 and the second soft cushion 22 are located on opposite sides of the support member 9, which makes the size of the cushion 2 consistent with the size of the support member 9, thus reducing the production cost of the garden chair 100.

Compared with the prior art, the garden chair 100 provided by the present disclosure makes the cushion 2 of the garden chair 100 easy to clean and replace by mounting the cushion 2 removably on the carrying frame 13, and the removed cushion can be applied to various functional kneeling cushions and seat upholstery mobile cushions.

In the description of the present disclosure, the terms "first" and "second" are used for descriptive purposes only and are not to be understood as indicating or implying relative importance or implicitly specifying the number of technical features indicated. Thus, the features qualified with "first" and "second" may explicitly or implicitly include one or more features.

The above embodiments of the present disclosure provide a detailed description of the garden chair, and the application of specific examples in this paper is to illustrate the principles and implementation of the present disclosure. The above embodiments of the description is only used to help understand the method of the present disclosure and its core ideas. For those skilled in the art, according to the ideas of the present disclosure, there will be changes in the specific implementation and the scope of application, in general, the content of this specification should not be understood as a limitation of the present disclosure.

What is claimed is:

1. A garden chair, comprising:

a garden chair body, comprising a first chair leg, a second chair leg, and a carrying frame defining a generally horizontal plane in a position of use; wherein the first chair leg is spaced apart relative to the second chair leg; an end of the carrying frame is arranged on the first chair leg, and the other end of the carrying frame is arranged on the second chair leg; and a cushion, removably arranged on the carrying frame;

wherein the cushion comprises a first soft cushion and a second soft cushion, and connection members; the first soft cushion and the second soft cushion are arranged on opposite sides of the carrying frame, respectively; two of the connection members are arranged on two ends of the first soft cushion, respectively; another two of the connection members are arranged on two ends of the second soft cushion, respectively; each of the two ends of the first soft cushion is detachably connected to a respective end of the two ends of the second soft cushion via respective connection members.

2. The garden chair according to claim 1, wherein each connection member is at least one of hook and loop, concealed buckle, button, zipper, snap, and strap.

3. The garden chair according to claim 2, wherein the first soft cushion comprises a first cushion body and a first connection body extending from the first cushion body; the connection members are arranged connecting the first cushion body and the second soft cushion such that the first soft cushion and the second soft cushion are detachably connected to each other.

4. The garden chair according to claim 3, wherein the carrying frame comprises a first connection rod and a second connection rod; the first connection rod and the second connection rod are relatively spaced apart; an end of the first connection rod and an end of the second connection rod are respectively rotatably arranged on the first chair leg; the other end of the first connection rod and the other end of the second connection rod are respectively rotatably arranged on the second chair leg.

5. The garden chair according to claim 4, further comprising a support member arranged between the first connection rod and the second connection rod; or, the support member is arranged on a side of the first soft cushion near the first connection rod and the second connection rod and on a side of the second soft cushion near the first connection rod and the second connection rod.

6. The garden chair according to claim 5, wherein in condition of the support member being arranged between the first connection rod and the second connection rod, the support member is removably arranged between the first connection rod and the second connection rod by a screw.

7. The garden chair according to claim 6, wherein the support member comprises a reinforcing frame and a reinforcing skeleton; the reinforcing skeleton is arranged in and connected to the reinforcing frame.

8. The garden chair according to claim 7, wherein the reinforcing skeleton is formed by a plurality of reinforcing bars intersecting with each other, and a plurality of through holes are defined between the plurality of reinforcing bars and between the plurality of reinforcing bars and the reinforcing frame.

9. A garden chair, comprising:

a garden chair body, comprising a first chair leg, a second chair leg, and a carrying frame defining a generally horizontal plane in a position of use; wherein the first chair leg is spaced apart relative to the second chair leg; an end of the carrying frame is arranged on the first chair leg, and the other end of the carrying frame is arranged on the second chair leg; and a cushion, removably arranged on the carrying frame;

wherein the cushion comprises a first soft cushion, a second soft cushion, and connection members; the first soft cushion and the second soft cushion are arranged on opposite sides of the carrying frame, respectively; an end of the first soft cushion is reversibly connected to an end of the second soft cushion; another end of the first soft cushion is detachably connected to another end of the second soft cushion via the connection members.

10. The garden chair according to claim 9, wherein each connection member is at least one of hook and loop, concealed buckle, button, zipper, snap, and strap.

* * * * *